US011773688B2

(12) United States Patent
Rothnie et al.

(10) Patent No.: US 11,773,688 B2
(45) Date of Patent: Oct. 3, 2023

(54) DOWNHOLE PACKER APPARATUS

(71) Applicant: Rubberatkins Limited, Aberdeen (GB)

(72) Inventors: Stuart Rothnie, Aberdeen (GB); Nicola Yeats, Aberdeen (GB)

(73) Assignee: RUBBERATKINS LIMITED, Aberdeen (GB)

( * ) Notice: Subject to any disclaimer, the term of this patent is extended or adjusted under 35 U.S.C. 154(b) by 285 days.

(21) Appl. No.: 17/023,573

(22) Filed: Sep. 17, 2020

(65) Prior Publication Data

US 2021/0087907 A1 Mar. 25, 2021

(30) Foreign Application Priority Data

Sep. 20, 2019 (GB) ..... 1913635

(51) Int. Cl.
*E21B 34/08* (2006.01)
*E21B 33/124* (2006.01)
*E21B 33/12* (2006.01)

(52) U.S. Cl.
CPC ..... *E21B 34/08* (2013.01); *E21B 33/124* (2013.01); *E21B 33/1208* (2013.01); *E21B 2200/06* (2020.05)

(58) Field of Classification Search
CPC ..... E21B 33/1294; E21B 32/12
USPC ..... 166/129, 133, 183
See application file for complete search history.

(56) References Cited

U.S. PATENT DOCUMENTS 4,577,695 A 3/1986 Wood
5,156,207 A 10/1992 Haugen et al.
6,554,076 B2 4/2003 Guillory et al.
8,316,943 B2 11/2012 Fagley, IV et al.
8,931,569 B2 1/2015 Fagley, IV et al.
9,428,997 B2 8/2016 Broussard et al.
9,580,989 B2 2/2017 Halfmann et al.
9,605,517 B2 3/2017 Buechler
10,119,368 B2 11/2018 Tunget
10,494,894 B2 12/2019 Al-Gouhi et al.
10,626,689 B2 4/2020 Moyes
(Continued)

FOREIGN PATENT DOCUMENTS

EP 2452039 B1 9/2020
WO WO-2016137440 A1 * 9/2016 ..... E21B 33/12

*Primary Examiner* — Cathleen R Hutchins
(74) *Attorney, Agent, or Firm* — Dinsmore & Shohl LLP

(57) ABSTRACT

A downhole packer apparatus for establishing a seal in an annulus between the apparatus and a wall of a bore or bore-lining tubing. The apparatus comprises a body and a plurality of sealing elements configured for mounting on the body, each sealing element engages the wall of the bore or bore-lining tubing dividing the annulus into a plurality of annulus portions. A bypass arrangement operatively associated with each of the sealing elements communicates fluid between the respective plurality of annulus portions. A valve arrangement is configured for controlling flow between the respective plurality of annulus portions via the fluid communication arrangement, and is configurable between a first configuration in which fluid communication between the respective plurality of annulus portions is prevented and a second configuration in which fluid communication between the respective plurality of annulus portions is permitted, in response to a predetermined threshold pressure differential across the valve arrangement.

14 Claims, 6 Drawing Sheets

(56) References Cited

U.S. PATENT DOCUMENTS

| | | | | |
|---|---|---|---|---|
| 10,662,750 | B2 | 5/2020 | Angman et al. | |
| 2001/0007284 | A1 | 7/2001 | French et al. | |
| 2010/0089587 | A1 | 4/2010 | Stout | |
| 2011/0101613 | A1 | 5/2011 | McRobb et al. | |
| 2012/0006563 | A1* | 1/2012 | Patel | E21B 43/14 166/325 |
| 2018/0080303 | A1 | 3/2018 | Radtke et al. | |
| 2020/0080404 | A1 | 3/2020 | Frosell et al. | |

* cited by examiner

DOWNHOLE PACKER APPARATUS

CROSS-REFERENCE TO RELATED APPLICATIONS

This application claims priority from Application 1913635.7 filed on Sep. 20, 2019 in the United Kingdom.

FIELD OF THE INVENTION

The present disclosure relates to a downhole packer apparatus, system and method for establishing a seal in an annulus, such as within a wellbore.

BACKGROUND OF THE INVENTION

Downhole sealing devices known as packers are used extensively in the oil and gas industry for sealing an annulus in a wellbore. In some instances, the packer takes the form of a casing packer, whereby the annulus to be sealed is between the packer and associated bore-lining tubing, e.g. casing or liner, and a bore wall. In other instances, the packer takes the form of a production packer, whereby the annulus to be sealed is between the packer and associated production tubing and the bore-lining tubing.

Conventional packers comprise an elastomeric annular sealing element mounted on a mandrel, the sealing element being expandable outwardly in the radial direction to engage the bore wall or the bore-lining tubing in which the packer is located, and thus sealing the annulus defined between the packer and the bore wall or bore-lining tubing.

Once in place and sealing the annulus, the packer may be utilised to isolate a region from fluid flow. The pressure on the fluid side of the packer may increase as operations are carried out in the isolated region. In some cases, if the pressure acting on the sealing element is too great, the sealing element of the packer may experience extrusion, lack of seal or compression set. In such an instance, the packer is not effective.

SUMMARY OF THE INVENTION

An aspect of the present disclosure relates to a downhole packer apparatus for use in establishing a seal in an annulus between the apparatus and a wall of a bore or bore-lining tubing. The apparatus includes each of a body, a plurality of sealing elements configured for mounting on the body, each sealing element configured to engage the wall of the bore or bore-lining tubing so as to divide the annulus into a plurality of annulus portions.

A bypass arrangement is operatively associated with each of the sealing elements, each bypass arrangement having a fluid communication arrangement for communicating fluid between the respective plurality of annulus portions, and a valve arrangement configured to control fluid flow between the respective plurality of the annulus portions via the fluid communication arrangement. The valve arrangement is configurable between a first configuration in which fluid communication between the respective plurality of annulus portions is prevented and a second configuration in which fluid communication between the respective plurality of annulus portions is permitted, in response to a predetermined threshold pressure differential across the valve arrangement.

In use, the apparatus may be positioned downhole so as to form an annulus between the apparatus and a wall of a bore or bore-lining tubing and actuated to establish a seal. Each seal element is configured to engage the wall of the bore or the bore-lining tubing to divide the annulus into a plurality of annulus portions. Each valve arrangement is configurable in a first configuration preventing fluid communication between the respective plurality of annulus portions and is reconfigurable to a second configuration permitting fluid communication between the respective plurality of annulus portions. The valve arrangement is reconfigurable between the first and second configurations in response to a predetermined pressure differential across the valve arrangement.

The bypass arrangements may be sequentially operable. In particular, the valve arrangements may be sequentially reconfigurable from their first configuration to their second configuration to permit fluid communication between the respective plurality of annulus portions. Thus, in sequential operation of the bypass arrangements, fluid may be communicated between the annulus portions sequentially to step down the pressure in each annulus portion in sequence.

Beneficially, the ability to step down the pressure in each annulus portion in sequence results in an apparatus that can withstand a substantially greater pressure differential than conventional packers, and thus provides effective isolation in high pressure downhole environments, without decreasing the effective sealing capability of the sealing elements.

As described above, each sealing element is configured to engage the wall of the bore or bore-lining tubing so as to divide the annulus into a plurality of annulus portions.

The apparatus may be configured so that when the sealing elements engage the wall of the bore or bore-lining tubing, the pressure differential across each valve arrangement corresponds to the pressure differential across the respective sealing element. The predetermined threshold pressure differential may be determined according to the pressure differential that each sealing element is able to withstand without a decrease in the effective sealing capability of the sealing element.

As described above, each valve arrangement is reconfigurable between the first and second configurations in response to a predetermined pressure differential across said valve arrangement. The predetermined threshold pressure differential may be a pressure drop (i.e. decrease in pressure from an upstream side of the valve arrangement to a downstream side of the valve arrangement).

The predetermined threshold pressure differential may be an integer pressure drop across said valve arrangement. Alternatively, the predetermined threshold pressure differential may be a percentage pressure drop.

Each valve arrangement may be a one-directional valve arrangement. Each valve arrangement may include or take the form of a check valve or the like.

Each valve arrangement may be reconfigurable from the first configuration to the second configuration when the pressure differential across the valve arrangement is equal to or greater than the predetermined threshold. Each valve arrangement may be reconfigurable from the second configuration to the first configuration when the pressure differential across the valve arrangement drops below the predetermined threshold.

Alternatively, each valve arrangement may be reconfigurable from the first configuration to the second configuration when the pressure differential across the valve arrangement is greater than the predetermined threshold. Each valve arrangement may be reconfigurable from the second configuration to the first configuration when the pressure differential across the valve arrangement is equal to or less than the predetermined threshold.

Each valve arrangement may comprise a piston. Each piston may have a sealing position wherein the respective valve arrangement is in the first configuration. Each piston may have a filling position wherein the respective valve arrangement is in the second configuration.

Each valve arrangement may comprise one or more biasing element. The biasing element may be a spring. Each biasing element may bias the respective piston towards its sealing position. Each piston may be movable from the sealing position to the filling position, against the bias of the respective biasing element, to reconfigure the respective valve arrangement from the first configuration to the second configuration, in response to the predetermined pressure differential.

The apparatus may include a valve sleeve associated with each annulus portion. Each valve sleeve may be mounted on the body. Each valve arrangement may be configured to control fluid flow from a first annulus portion of the respective plurality of annulus portions to a second annulus portion of the respective plurality of annulus portions via the respective fluid communication arrangement. Each valve arrangement may be configured to control fluid flow from a first annulus portion of the respective plurality of annulus portions to the respective fluid communication arrangement. Each valve arrangement may be mounted in the valve sleeve associated with the first annulus portion of the respective plurality of annulus portions.

The fluid communication arrangement may be configured to communicate liquid and/or gas.

The fluid communication arrangement may include a sealed space. As described above, the apparatus may also include a valve sleeve associated with each annulus portion. The sealed space may be provided between the valve sleeve associated with the first annulus portion of the respective plurality of annulus portions and the body. Each sealed space may be sealed by seals, for example a pair of seals. The seals may be axially spaced. The sealed space may be annular. Flow of fluid from the first annulus portion of the respective plurality of annulus portions to the respective sealed space may be controlled by the respective valve arrangement.

The fluid communication arrangement may include a conduit. Each conduit may be a channel, a pipe, a line or the like, suitable for receiving and communicating fluid. A first end of the conduit may be configured for fluid communication with the respective sealed space. A second end of the conduit may be configured for fluid communication with the second annulus portion of the respective plurality of annulus portions. The conduit may be circumferentially spaced from the valve arrangement. The conduit may extend through the body. The conduit may extend through the valve sleeve associated with the second annulus portion of the respective plurality of annulus portions. Each conduit may extend the length of the body. Each conduit may be blocked, closed, covered or sealed at each end of the body.

The conduits may be circumferentially distributed. The fluid conduits may be circumferentially spaced 15 degrees apart.

The conduits may be circumferentially distributed. The fluid conduits may be circumferentially spaced 15 degrees apart.

Each bypass arrangement may be configured to prevent a pressure differential across the respective sealing element of the plurality of sealing elements exceeding the predetermined threshold pressure differential.

As described above, the bypass arrangements may be configured for sequential operation.

A first of the bypass arrangements may be configured for fluid communication with a first end of the apparatus. The first of the bypass arrangements may be a first bypass arrangement in the sequence of operation of the bypass arrangements. The first of the bypass arrangements may be configured for initiating sequential operation of the bypass arrangements in response to receiving fluid from the first end of the apparatus.

Each bypass arrangement may be configured to control fluid flow between the respective plurality of annulus portions in a first direction. The first direction may be from uphole to downhole. Alternatively, the first direction may be from downhole to uphole.

The bypass arrangement may define a forward bypass arrangement and the apparatus may further comprise a reverse bypass arrangement operatively associated with each of the sealing elements. Each reverse bypass arrangement may be configured to control fluid flow between the respective plurality of annulus portions in a second direction opposite the first direction.

The reverse bypass arrangements may be configured for sequential operation. The reverse bypass arrangements may be configured for operation in a sequence of operation opposite to the sequence of operation of the forward bypass arrangements. In use, the reverse bypass arrangements may allow for reverse operation of the apparatus. Accordingly, the apparatus may be utilised to effectively isolate the annulus on either side of the apparatus without removal and refitting of the apparatus.

A first of the reverse bypass arrangements may be configured for fluid communication with a second end of the apparatus. The second end of the apparatus may be an end of the apparatus opposite the first end of the apparatus. The first of the reverse bypass arrangements may be a first reverse bypass arrangement in the reverse sequence of operation of the reverse bypass arrangements. The first of the reverse bypass arrangements may be configured for initiating the sequential operation of the reverse bypass arrangements in response to receiving fluid from the second end of the apparatus.

As described above, the apparatus comprises a body and a plurality of sealing elements configured for mounting on the body.

The plurality of sealing elements may comprise four sealing elements. However, it will be understood that the apparatus may alternatively comprise any suitable number of sealing elements e.g 2, 3, 5, 6, . . . n sealing elements.

Each sealing element of the plurality of sealing elements may be actuable between a run in configuration and a sealing configuration. Each sealing element may engage the wall of the bore or bore-lining tubing so as to divide the annulus into a plurality of annulus portions when the sealing element is in its sealing configuration.

Each sealing element may be elastomeric.

The body may be a mandrel, a tubular, a pipe, a tubing, a sleeve or the like. The body may include connectors at each end of the body for connection to a tubular, a pipe, a string or the like. The connectors may include threaded connectors, such as threaded pin and/or box connectors.

The body may be a unitary body. Alternatively, the body may include a plurality of body portions. The body portions may be axially spaced apart. Each respective sealing element and valve sleeve may be mounted on a respective body portion.

Another aspect of the present disclosure relates to a downhole system includes the downhole packer apparatus as described above.

Another aspect of the present disclosure relates to use of the downhole packer apparatus described above to seal an annulus in a wellbore.

Another aspect of the present disclosure relates to a downhole packer apparatus. The apparatus may be configured to establish a seal in an annulus between the apparatus and a wall of a bore or bore-lining tubing. The apparatus may include a body. The apparatus may include a plurality of sealing elements. The plurality of sealing elements may be configured for mounting on the body. Each sealing element may be configured to engage the wall of a bore or bore-lining tubing so as to divide the annulus into a plurality of annulus portions. The apparatus may include a bypass arrangement operatively associated with each of the sealing elements. The bypass arrangement may comprise a fluid communication arrangement for communicating fluid between the respective plurality of annulus portions. The bypass arrangement may include a valve arrangement configured to control fluid flow between the respective plurality of annulus portions via the fluid communication arrangement. The valve arrangement may be configurable between a first configuration in which fluid communication between the respective plurality of annulus portions is prevented and a second configuration in which fluid communication between the respective plurality of annulus portions is permitted. The valve arrangement may be configurable between the first and second configurations in response to a predetermined threshold pressure differential across the valve arrangement.

It should be understood that the features defined above in accordance with any aspect of the disclosure or below in relation to any specific example, may be utilised, either alone or in combination, with any other defined feature, in any other aspect or example.

BRIEF DESCRIPTION OF THE DRAWINGS

These and other aspects of the present disclosure will now be described, by way of example only, with reference to the accompanying drawings, in which.

DETAILED DESCRIPTION OF THE PREFERRED EMBODIMENTS

Figure 1:
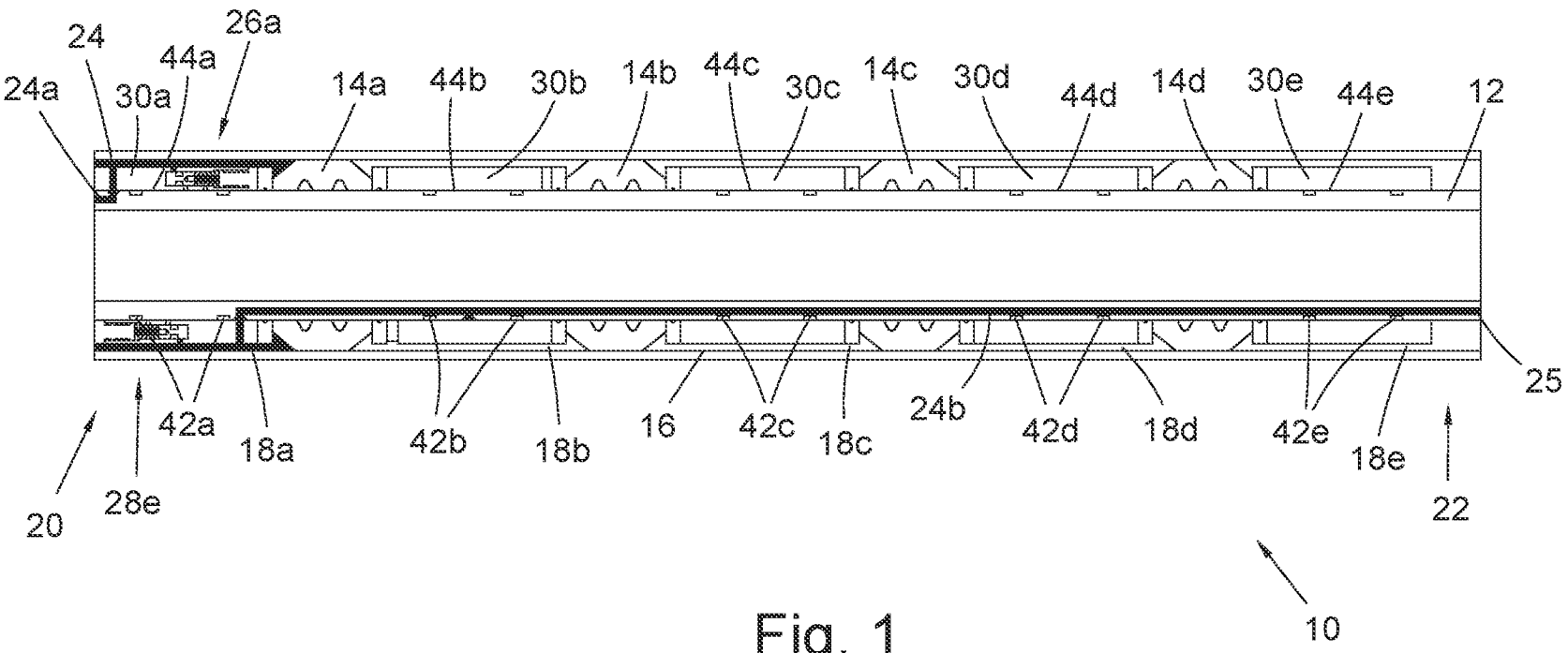
FIG. 1 is a section view of a packer apparatus.

In reference to FIG. 1, a packer apparatus 10 comprises a body 12. In the present example the body 12 is in the form of a mandrel. The apparatus 10 comprises a plurality of sealing elements 14 mounted on the body 12. Each sealing element 14 provides a seal in an annulus between the apparatus 10 and a casing 16 in a wellbore. The sealing elements 14 divide the annulus into a plurality of annulus portions 18. A plurality of valve sleeves 30 are mounted on the body 12, each valve sleeve 30 located within a respective annulus portion 18. A plurality of cavity seal pairs 42 are provided between the body 12 and the respective valve sleeves 30. In the present example the cavity seal pairs 42 are provided on the body 12. In the present example each cavity seal is an o-ring. The plurality of cavity seal pairs 42 provide a plurality of respective sealed spaces 44. Each space 44 is formed axially between a respective cavity seal pair 42 and radially between the body 12 and the respective valve sleeve 30. The cavity seal pairs 42 seal the respective space 44 from the respective annulus portion 18.

The apparatus 10 includes a plurality of conduit systems (only an initiation conduit system 24 can be seen in FIG. 1). The initiation conduit system 24 comprises a first conduit 24*a* and a second conduit 24*b*. The first conduit 24*a* of the initiation conduit system 24 receives fluid from the first end 20 of the apparatus 10 and provides it to the first annulus portion 18*a*. The first conduit 24*a* of the initiation conduit system 24 extends through the body 12 from the first end 20 of the apparatus 10 to the first valve sleeve 30*a*, and through the first valve sleeve 30*a* from the body 12 to the first annulus portion 18*a*. Said fluid received from the first end 20 of the apparatus 10 fills the first annulus portion 18*a* and enters a second conduit 24*b* of the initiation conduit system 24. The second conduit 24*b* of the initiation conduit system 24 extends through the first valve sleeve 30*a* from the first annulus portion 18*a* to the body 12, and through the body 12 from the first valve sleeve 30*a* to the second end 22 of the apparatus 10. The second conduit 24*b* of the initiation conduit system 24 includes a branch in the body 12 extending to the second space 44*b*, to allow for reverse operation of the apparatus. The second conduit 24*b* of the initiation conduit system 24 extends along a side of the apparatus 10 opposite the side of the apparatus 10 along which the first conduit 24*a* of the initiation conduit system 24 extends. The second conduit 24*b* of the initiation conduit system 24 has a sealed end 25 at the second end 22 of the apparatus 10. Once the initiation conduit system 24 and the first annulus portion 18*a* are filled with fluid, the sealed end 25 results in the pressure within the first conduit 24 and the first annulus portion 18*a* increasing.

The apparatus 10 comprises a plurality of valve arrangements 26 (only the first valve arrangement 26*a* can be seen in FIG. 1) and a plurality of reverse valve arrangements 28 (only the fifth reverse valve arrangement 28*e* can be seen in FIG. 1). Each of the valve arrangements 26 and a respective one of the reverse valve arrangements 28 are mounted in a respective valve sleeve 30. Each reverse valve arrangement 28 is located on a side of the apparatus 10 opposite a side of the apparatus 10 on which a respective valve arrangement 26 is located. For example, as can be seen in FIG. 1, the first valve arrangement 26*a* is located on the side of the apparatus 10 along which the first conduit 24*a* of the initiation conduit system 24 extends and the fifth reverse valve arrangement 28*e* is located on the side of the apparatus 10 along which the second conduit 24*b* of the initiation conduit system 24 extends. The reverse valve arrangements 28 are structured and operate in a corresponding manner to the valve arrangements 26 but are mounted in the apparatus 10 in a reverse orientation. In the present example, the valve arrangements 26 and reverse valve arrangements 28 are check valves, as shown in more detail in FIGS. 2*a*-2*c* in respect of the first valve arrangement 26*a*.

The valve arrangements 28 are configured such that the pressure differential across each sealing element 14 will not exceed a predetermined extent to which the sealing element 14 will function effectively. Four sealing elements 14 are provided in the present example.

Figure 2A:
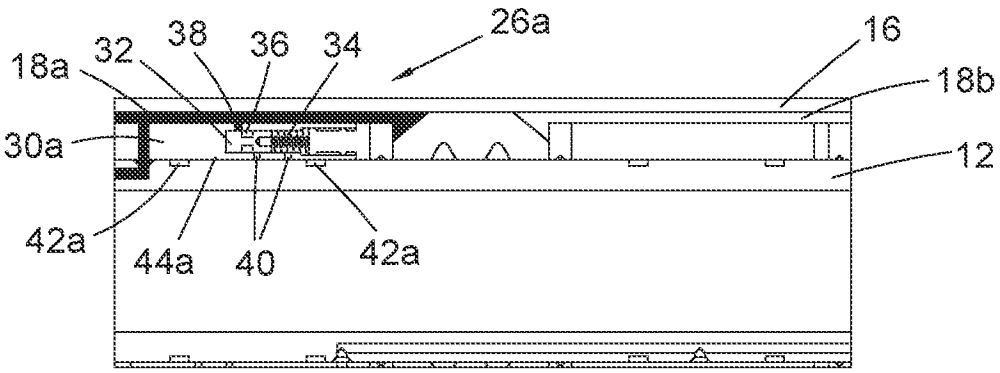
FIGS. 2*a*, 2*b* and 2*c* are detail section views of a first valve and seal element arrangement of the packer apparatus of FIG. 1 during operation.
Figure 2C:
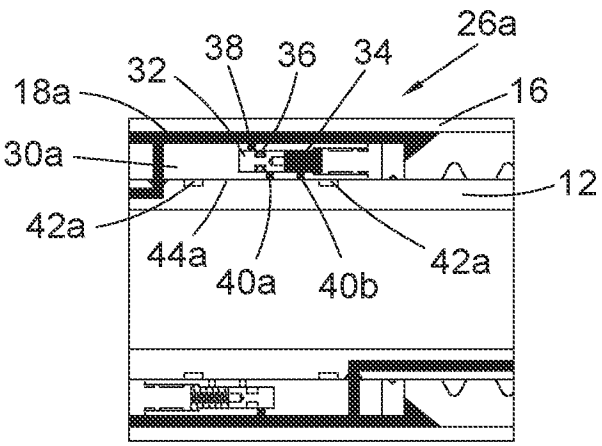
Figure 2B:
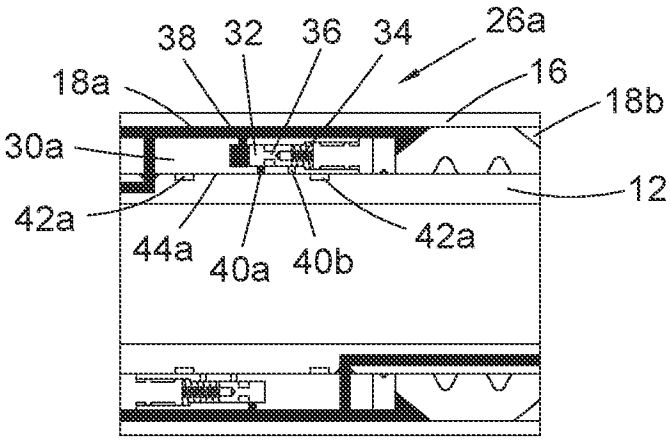

In reference to FIGS. 2*a*-2*c*, the structure and operation of the first valve arrangement 26*a* is described. Each of the second to fifth valve arrangements 26 are structured and operate in a corresponding manner to the first valve arrangement 26*a*. Each of the first to fifth reverse valve arrangements 28 are structured and operate in a corresponding manner to the first valve arrangement 26*a* but are mounted in the apparatus 10 in a reverse orientation.

The first valve arrangement 26*a* is mounted in the first valve sleeve 30*a*. The first valve arrangement 26*a* comprises a piston 32 and a biasing element 34. In the present example the biasing element 34 is a spring. The piston 32 is moveable between a sealing position and a filling position, as will be described below with reference to the operation of the first valve arrangement 26*a*. A piston seal 36 is mounted on the piston 32. In the present example the piston seal 36 is an o-ring. The piston seal 36 provides isolation between ends of the piston 32. The position of the piston seal 36 controls flow across the first valve arrangement 26*a*. The first valve sleeve 30*a* comprises an annulus side port 38 that extends between the first valve arrangement 26*a* and the first annulus portion 18*a*. The annulus side port 38 is in communication with the first annulus 18*a* at an outer surface of the first valve sleeve 30*a* adjacent the casing 16. The first cavity seal pair 42*a* seal the first space 44*a* from the first annulus portion 18*a*. The first valve sleeve 30*a* further comprises a pair of space side ports 40 that extend between the first valve arrangement 26*a* and the first space 44*a*. The space side ports 40 are in communication with the first space 44*a* at an internal surface of the valve sleeve 30*a* adjacent the body 12. As is described in greater detail below, the first space 44*a* is in fluid communication with a second annulus portion 18*b* via a first conduit system 46 (not shown in FIGS. 2*a*-2*c*) of the plurality of conduit systems. Each respective space and conduit system forms a fluid communication arrangement between adjacent annulus portions 18 either side of the respective sealing element 14. Each respective valve arrangement and fluid communication arrangement forms a bypass arrangement to control flow bypassing each respective sealing element 14. The first sealing element 14*a* separates the first and second annulus portions 18*a*, 18*b*. Accordingly, the pressure differential across the piston 32 in the sealing position corresponds to the pressure differential across the first sealing element 14*a*.

The first valve arrangement 26*a* is mounted in the first valve sleeve 30*a*. The first valve arrangement 26*a* comprises a piston 32 and a biasing element 34. In the present example the biasing element 34 is a spring. The piston 32 is moveable between a sealing position and a filling position, as will be described below with reference to the operation of the first valve arrangement 26*a*. A piston seal 36 is mounted on the piston 32. In the present example the piston seal 36 is an o-ring. The piston seal 36 provides isolation between ends of the piston 32. The position of the piston seal 36 controls flow across the first valve arrangement 26*a*. The first valve sleeve 30*a* comprises an annulus side port 38 that extends between the first valve arrangement 26*a* and the first annulus portion 18*a*. The annulus side port 38 is in communication with the first annulus 18*a* at an outer surface of the first valve sleeve 30*a* adjacent the casing 16. The first cavity seal pair 42*a* seal the first space 44*a* from the first annulus portion 18*a*. The first valve sleeve 30*a* further comprises a pair of space side ports 40 that extend between the first valve arrangement 26*a* and the first space 44*a*. The space side ports 40 are in communication with the first space 44*a* at an internal surface of the valve sleeve 30*a* adjacent the body 12. As is described in greater detail below, the first space 44*a* is in fluid communication with a second annulus portion 18*b* via a first conduit system 46 (not shown in FIGS. 2*a*-2*c*) of the plurality of conduit systems. Each respective space and conduit system forms a fluid communication arrangement between adjacent annulus portions 18 either side of the respective sealing element 14. Each respective valve arrangement and fluid communication arrangement forms a bypass arrangement to control flow bypassing each respective sealing element 14. The first sealing element 14*a* separates the first and second annulus portions 18*a*, 18*b*. Accordingly, the pressure differential across the piston 32 in the sealing position corresponds to the pressure differential across the first sealing element 14*a*.

Figure 3:
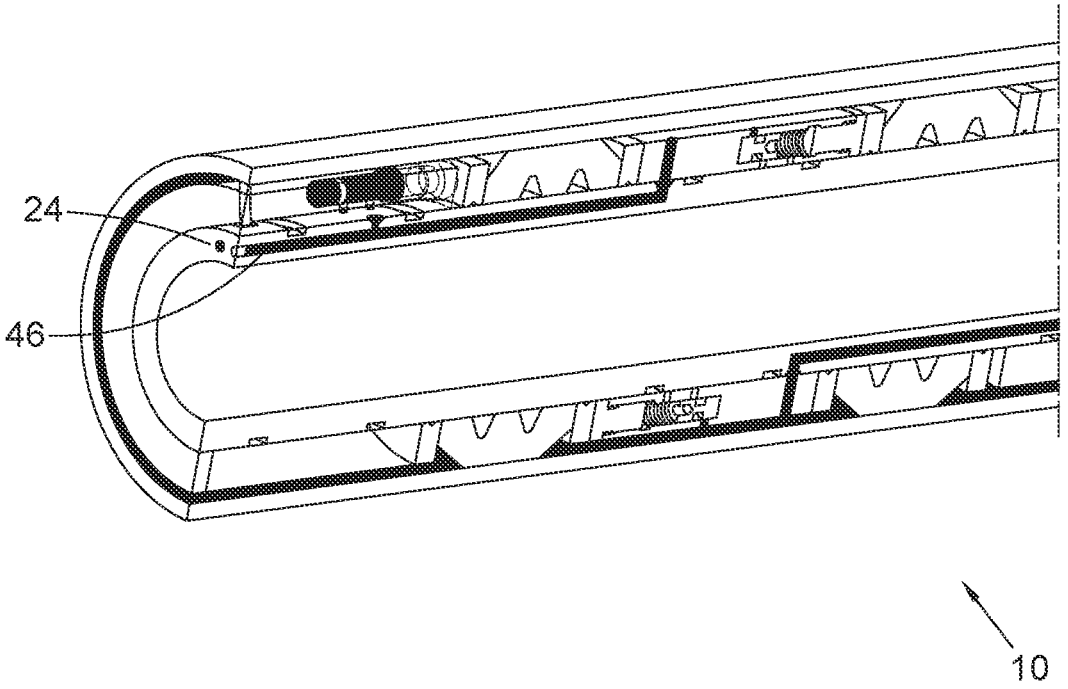
FIG. 3 is a perspective section view of the first valve and seal element arrangement and a second valve and seal element arrangement of the packer apparatus of FIG. 1.

In reference to FIG. 3, the first conduit system 46 is provided in the apparatus 10. In the present example the first conduit system 46 is circumferentially spaced from the initiation conduit system 24 by 15°, however in other examples the circumferential spacing between the conduit systems may be greater or less than 15°.

Figure 4A:
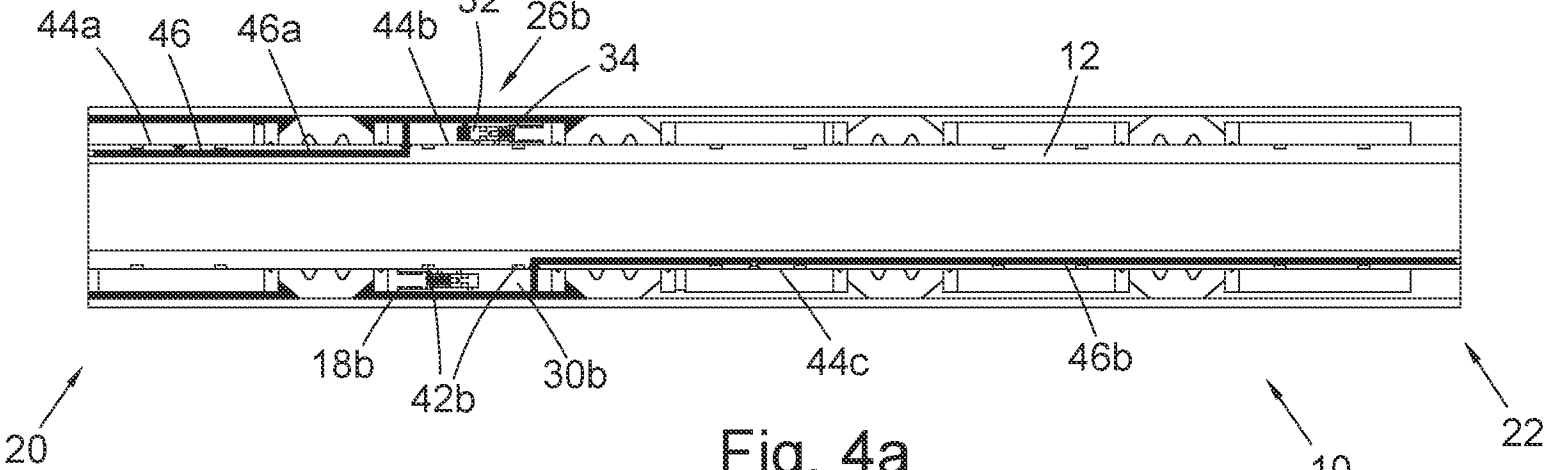
FIGS. 4*a* and 4*b* are section views of the packer apparatus of FIG. 1 during operation of the second valve and seal element arrangement.
Figure 4B:
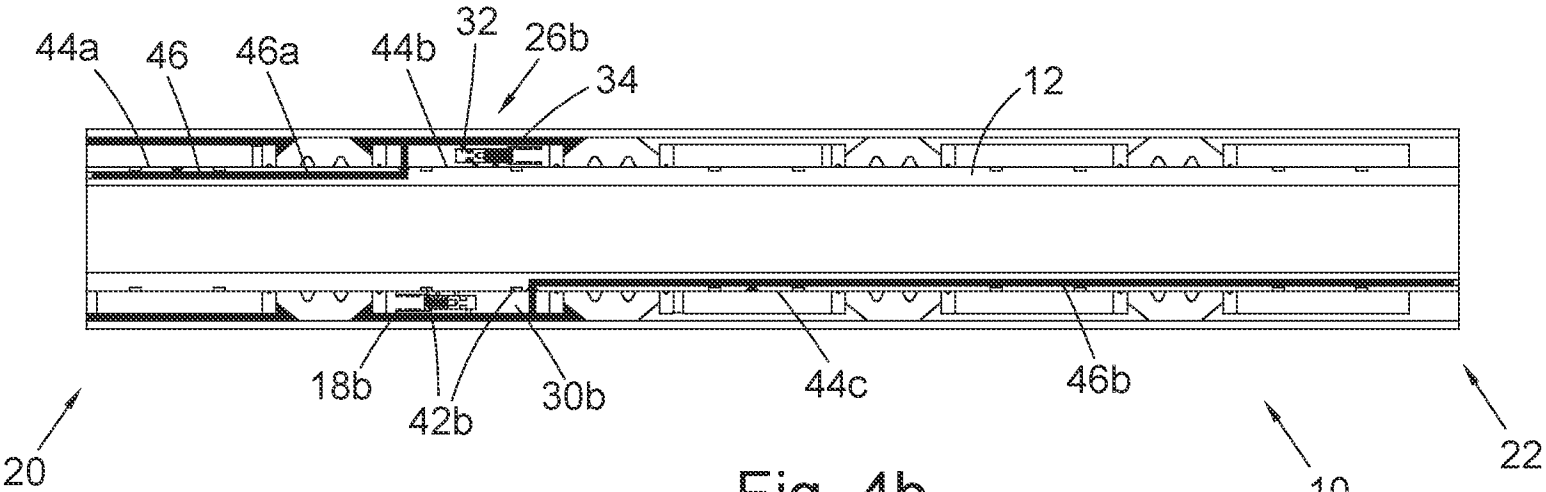

In reference to FIGS. 4*a* and 4*b*, the first conduit system 46 in the apparatus 10 has a first conduit 46*a* extending through the body 12 from a first end 20 of the apparatus 10 to a second valve sleeve 30*b*, and through the second valve sleeve 30*b* from the body 12 to the second annulus portion 18*b*. The first conduit 46*a* of the first conduit system 46 includes a branch in the body 12 that extends to the first space 44*a*, therefore the first conduit system 46 receives fluid from the first space 44*a*. The first conduit system 46 has a second conduit 46*b* extending along a side of the apparatus 10 opposite the side of the apparatus 10 along which the first conduit 46*a* of the first conduit system 46 extends. The second conduit 46*b* extends through the second valve sleeve 30*b* from the second annulus portion 18*b* to the body 12, and through the body 12 from the second valve sleeve 30*b* to the second end 22 of the apparatus 10. The second conduit 46*b* includes a branch in the body 12 extending to the third space 44*c*, to allow for reverse operation of the apparatus 10. The first conduit system 46 is sealed at both the first and second ends 20, 22 of the apparatus 10. Fluid received by the first conduit system 46 from the first space 44*a* will fill the first conduit system 46 and the second annulus portion 18*b* to pressurise the second annulus portion 18*b*.

With continued reference to FIGS. 4*a* and 4*b*, a second valve arrangement 26*b* is constructed in a corresponding manner to the first valve arrangement 26*a* and operates in a corresponding manner to that described above in respect of the first valve arrangement 26*a*. As the pressure in the second annulus portion 18*b* increases the piston 32 of the second valve arrangement 26*b* will move against the bias of the biasing element 34 from the closed position to the filling position when the pressure differential across the piston 32 exceeds the predetermined threshold, as shown in FIG. 4*a*. The piston 32 in the filling position will allow fluid to flow from the second annulus portion 18*b* to the second space 44*b*, the second space 44*b* located axially between the second cavity seal pair 42*b* and radially between the second valve sleeve 30*b* and the body 12. Fluid will then flow from the second space 44*b* to a second conduit system 48 in the apparatus 10 (not shown in FIGS. 4*a* and 4*b*), and to the biasing element 34 of the second valve 26*b*. When the pressure differential across the piston 32 drops below the predetermined threshold the biasing element 34 will return the piston 32 to the closed position, as shown in FIG. 4*b*.

Figure 5A:
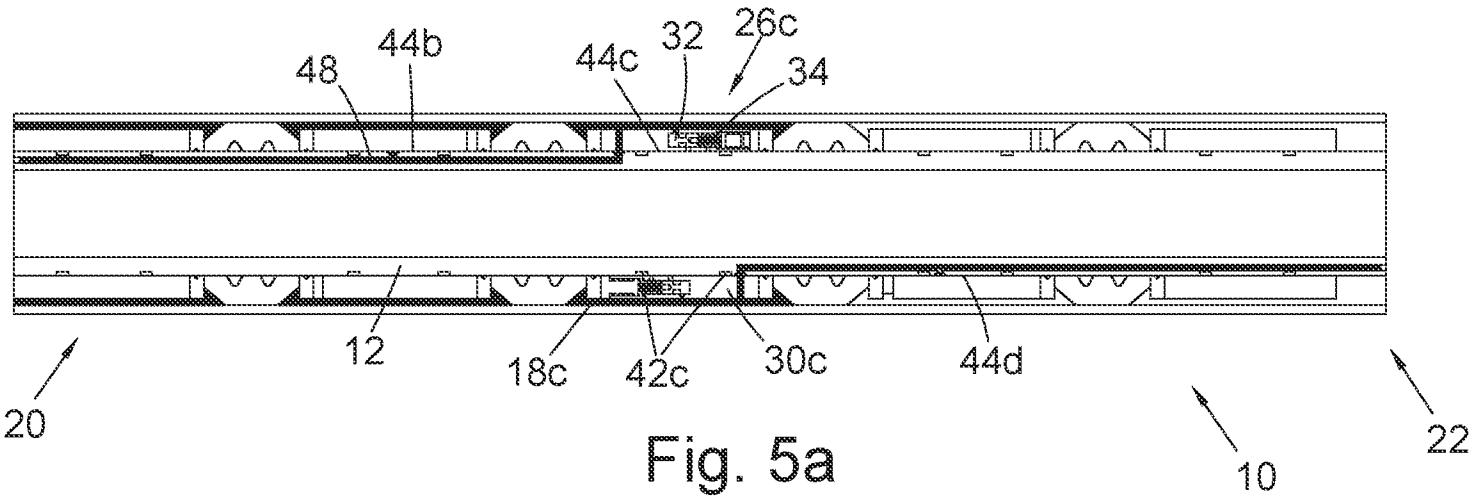
FIGS. 5*a* and 5*b* are section views of the packer apparatus of FIG. 1 during operation of a third valve and seal element arrangement of the packer apparatus.
Figure 5B:
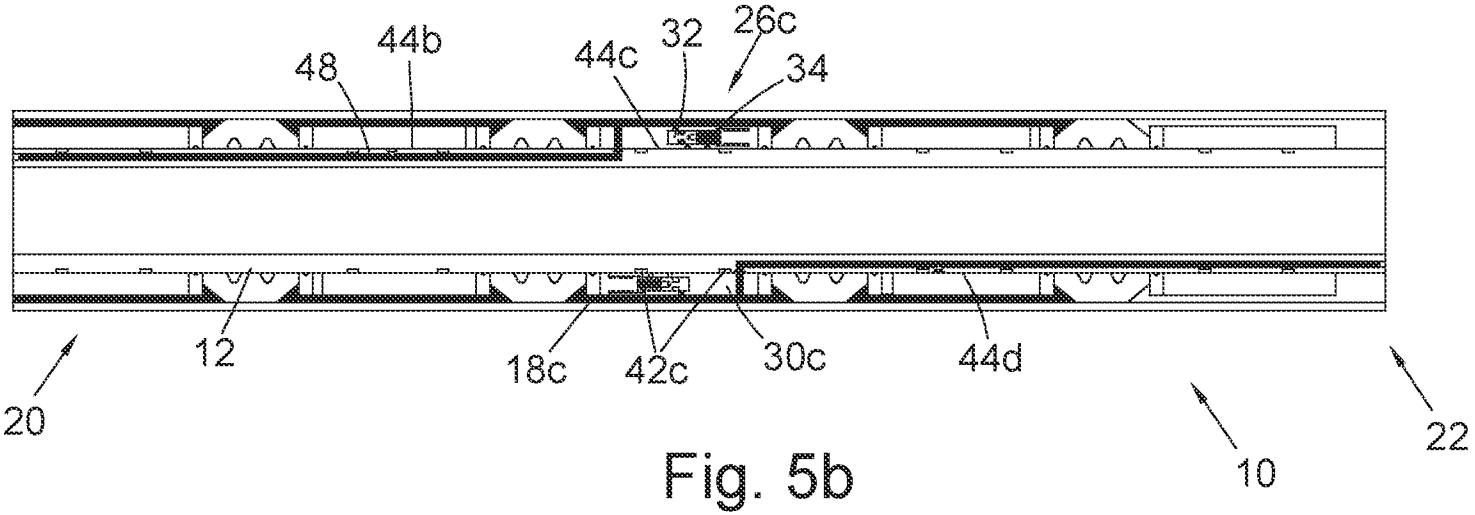

As shown in FIGS. 5*a* and 5*b*, the second conduit system 48 in the apparatus 10 is constructed in a similar manner to the first conduit system 46. In the present example the second conduit system 48 is circumferentially spaced from the first conduit system 46 by 15°, however in other examples the circumferential spacing between the conduit systems may be greater or less than 15°. The second conduit system 48 has a first conduit extending through the body 12 from a first end 20 of the apparatus 10 to a third valve sleeve 30*c*, and through the third valve sleeve 30*c* from the body 12 to a third annulus portion 18*c*. The first conduit of the second conduit system 48 includes a branch in the body 12 that extends to the second space 44*b*, therefore the second conduit system 48 is in fluid communication with the space 44*b*. The second conduit system 48 in the apparatus 10 also has a second conduit extending along a side of the apparatus 10 opposite a side of the apparatus 10 along which the first conduit extends. The second conduit extends through the third valve sleeve 30*c* from the third annulus portion 18*c* to the body 12, and through the body 12 from the third valve sleeve 30*c* to the second end 22 of the apparatus 10. The second portion includes a branch in the body 12 extending to the fourth space 44*d*, to allow for reverse operation of the apparatus 10. The second conduit system 48 is sealed at both the first and second ends 20, 22 of the apparatus 10. Fluid received by the second conduit system 48 from the second space 44*b* will fill the second conduit system 48 and the third annulus portion 18*c* to pressurise the third annulus portion 18*c*.

With continued reference to FIGS. 5*a* and 5*b*, a third valve arrangement 26*c* is constructed and operates in a corresponding manner to the first and second valve arrangements 26*a*, 26*b*. As the pressure in the third annulus portion 18*c* increases the piston 32 of the third valve arrangement 26*c* will move against the bias of the biasing element 34 from the closed position to the filling position when the pressure differential across the piston 32 exceeds the predetermined threshold. The piston 32 in the filling position will allow fluid to flow from the third annulus portion 18*c* to a third space 44*c*, the third space 44*c* axially between a third cavity seal pair 42*c* and radially between the third valve sleeve 30*c* and the body 12. Fluid will then flow from the third space 44*c* to a third conduit system 50 (not shown in FIGS. 5*a* and 5*b*) in the apparatus 10, and to the biasing element 34 of the third valve arrangement 26*c*. When the pressure differential across the piston 32 drops below the predetermined threshold the biasing element 34 will return the piston 32 to the closed position, as shown in FIG. 5*b*.

Figure 6:
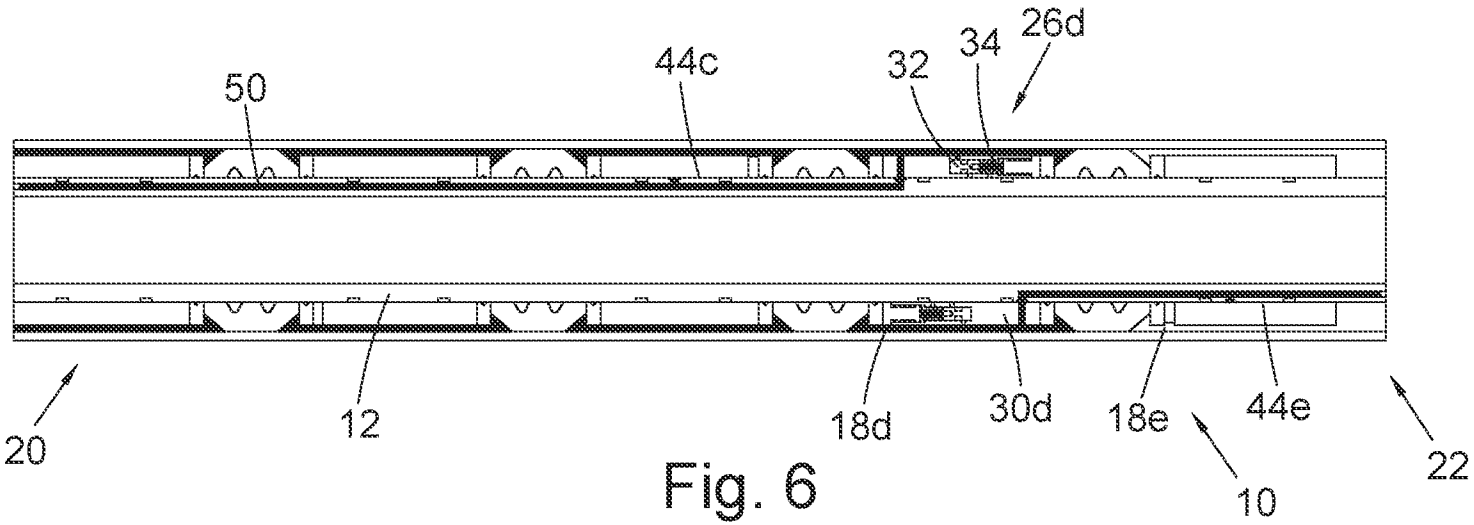
FIG. 6 is a section view of the packer apparatus of FIG. 1 during operation of a fourth valve and seal element arrangement of the packer apparatus.

As shown in FIG. 6, the third conduit system 50 in the apparatus 10 is constructed in a similar manner to the first and second conduit systems 46, 48. The third conduit system 50 is circumferentially spaced from the second conduit system 48 by 15°, however in other examples the circumferential spacing between the conduit systems may be greater or less than 15°. The third conduit system 50 has a first conduit extending through the body 12 from the first end 20 of the apparatus 10 to a fourth valve sleeve 30*d*, and through the fourth valve sleeve 30*d* from the body 12 to a fourth annulus portion 18*d*. The first conduit of the third conduit system 50 includes a branch in the body 12 that extends to the third space 44*c*, therefore the first conduit of the third conduit system 50 is in fluid communication with the third space 44*c*. The third conduit system 50 in the apparatus 10 also has a second conduit. The second conduit extends along a side of the apparatus 10 opposite a side of the apparatus 10 along which the first conduit extends. The second conduit extends through the fourth valve sleeve 30*d* from the fourth annulus portion 18*d* to the body 12, and through the body 12 from the fourth valve sleeve 30*d* to the second end 22 of the apparatus 10. The second conduit of the third conduit system 50 includes a branch in the body 12 extending to the fifth space 44*e*, to allow for reverse operation of the apparatus 10. The third conduit system 50 is sealed at both the first and second ends 20, 22 of the apparatus 10. The third conduit system 50 receives fluid from the third space 44*c*. Fluid from the third space 44*c* will fill the third conduit system 50 and the fourth annulus portion 18*d* to pressurise the fourth annulus portion 18*d*.

With continued reference to FIG. 6, a fourth valve arrangement 26*d* is constructed and operable in a corresponding manner to the first, second and third valve arrangements 26*a*, 26*b*, 26*c*. However, in the present example, the pressure in the fourth annulus portion 18*d* is not sufficient to increase the pressure differential across the piston 32 of the fourth valve arrangement 26*d* to exceed the predetermined threshold and overcome the bias of the biasing element 34. Therefore the piston 32 of the fourth valve arrangement 26*d* remains in the sealing position, and a fifth annulus portion 18*e* is isolated.

Figure 7:
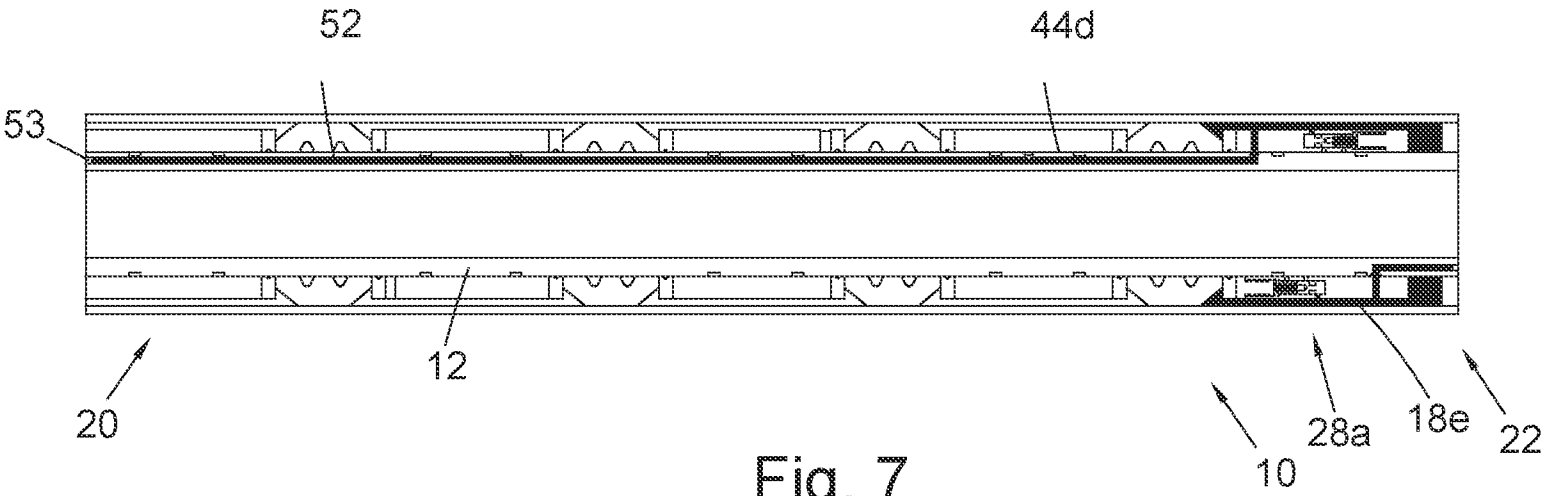
FIG. 7 is a section view of the packer apparatus of FIG. 1 prior to reverse operation of the packer apparatus.

In reference to FIGS. 6 and 7, the fifth annulus portion 18*e* is in fluid communication with a reverse initiation conduit system 52. The reverse initiation conduit system 52 is circumferentially spaced from the third conduit system 50 by 15°, however in other examples the circumferential spacing between the conduit systems may be greater or less than 15°. The reverse initiation conduit system 52 has a first conduit extending through the body 12 from the first end 20 of the apparatus 10 to a fifth valve sleeve 30*e*, and through the fifth valve sleeve 30*e* from the body 12 to the fifth annulus portion 18*e*. The first conduit of the reverse initiation conduit system 52 includes a branch in the body 12 that extends to the fourth space 44*d*. The first conduit of the reverse initiation conduit system 52 has a sealed end 53 at the first end 20 of the apparatus 10. The reverse initiation conduit system 52 also has a second conduit. The second conduit of the reverse initiation conduit system 52 extends along a side of the apparatus 10 opposite a side of the apparatus 10 along which the first conduit extends. The second conduit extends through the fifth valve sleeve 30*e* from the fifth annulus portion 18*e* to the body 12, and through the body 12 from the fifth valve sleeve 30*e* to the second end 22 of the apparatus. The second conduit of the reverse initiation conduit system 52 is in fluid communication with the second end 22 of the apparatus. Thus, when the fifth annulus portion 18*e* is isolated, the second end 22 of the apparatus is isolated.

Reverse operation of the apparatus 10 will be described with reference to FIG. 7. The first to fifth reverse valve arrangements 28 are operable in a reverse sequence to the first to fifth valve arrangements 26. In operation of the reverse valve arrangements, fluid flows through each conduit system 24, 46, 48, 50, 52 in a reverse direction, i.e. fluid is received by the second conduit and fills the first conduit. The reverse valve arrangements can be used to isolate the first end 20 of the apparatus 10 from fluid at the second end 22 of the apparatus. The reverse operation of the apparatus 10 is initiated by the reverse initiation conduit system receiving fluid from the second end 22 of the apparatus 10. The sealed end 53 of the reverse initiation conduit system 52 allows the reverse initiation conduit system 52 and the fifth annulus portion 18*e* to fill with fluid and the pressure in the fifth annulus portion 18*e* to increase. The first reverse valve arrangement 28*a* will operate in a corresponding manner to the first valve 26*a* when the pressure differential across the first reverse valve 28*a* exceeds the predetermined threshold. Fluid will be permitted to flow from the fifth annulus portion 18*e* to the fifth space 44*e*, and from the fifth space 44*e* to the second conduit of the third conduit system 50 (not shown in FIG. 7). The fluid will fill the third conduit system 50 and the fourth annulus portion 18*d*. The reverse valve arrangements 28 will then be operated as described above in respect of the valve arrangements 26, but sequentially from the second end 22 to the first end 20 of the apparatus 10, rather than from the first end 20 to the second end 22 of the apparatus 10 as with the valve arrangements 26.

It will be understood that various modifications may be made without departing from the scope of the claimed invention.

For example, wherein in the illustrated apparatus described above the body is in the form of a mandrel, the body may alternatively be in the form of a tubular, a pipe, a tubing, a sleeve or the like.

In the illustrated apparatus described above the annulus is formed between the apparatus and a casing, however the annulus may alternatively be between the apparatus and a bore-wall.

In the illustrated apparatus described above the cavity seal pairs are o-rings axially spaced apart on the body. The cavity seal pairs may alternatively be provided on the valve sleeves, or on the valve sleeves and the body. Each cavity seal may alternatively be any other suitable seal type to form a sealed space therebetween.

In the illustrated apparatus described above the valve arrangements comprise check valves, however the valve arrangements may alternatively comprise any other suitable valve type.

In the illustrated apparatus described above there are four sealing elements, however there may alternatively be any number of sealing elements necessary such that the apparatus can provide isolation of an end of the apparatus whilst ensuring that the sealing element at the isolated end of the apparatus has a pressure differential across it that does not exceed the predetermined threshold. There is a bypass arrangement associated with each sealing element. Any number of sealing elements and bypass arrangements may be provided to ensure that the pressure is sufficiently reduced in the subsequent annulus portions that one of the valve arrangements will not permit fluid flow.

In the illustrated apparatus described above the valve arrangement biasing element is a spring, however the biasing element may alternatively be any other suitable device.

In the illustrated apparatus described above the valve arrangement piston seal is an o-ring, however any suitable seal type may be used.

The invention claimed is:

1. A downhole packer apparatus for use in establishing a seal in an annulus between the apparatus and a wall of a bore or bore-lining tubing, the apparatus comprising:

a body;

a plurality of sealing elements configured for mounting on the body, each sealing element configured to engage the wall of the bore or bore-lining tubing so as to divide the annulus into a plurality of annulus portions; and a bypass arrangement operatively associated with each of the sealing elements, each bypass arrangement comprising a fluid communication arrangement for communicating fluid between the respective plurality of annulus portions, and a valve arrangement configured to control fluid flow between the respective plurality of annulus portions via the fluid communication arrangement, the valve arrangement configurable between a first configuration in which fluid communication between the respective plurality of annulus portions is prevented and a second configuration in which fluid communication between the respective plurality of annulus portions is permitted, in response to a predetermined threshold pressure differential across the valve arrangement; and a valve sleeve associated with each annulus portion;

wherein each fluid communication arrangement comprises:

a sealed space between the valve sleeve associated with a first annulus portion of the respective plurality of annulus portions, and the body; and a conduit extending through the body and configured to communicate fluid between the sealed space and second annulus portion of the respective plurality of annulus portions.

2. The downhole packer apparatus of claim 1, wherein each valve arrangement comprises a piston and a biasing element.

3. The downhole packer apparatus of claim 2, wherein each piston has a sealing position wherein the respective valve arrangement is in the first configuration, and a filling position wherein the respective valve arrangement is in the second configuration.

4. The downhole packer apparatus of claim 3, wherein each biasing element biases the respective piston towards the respective pistons closed position.

5. The downhole packer apparatus of claim 4, wherein each piston is movable from the sealing position to the filling position, against the bias of the respective biasing element, to reconfigure the respective valve arrangement from the first configuration to the second configuration, in response to the pressure differential across the respective valve arrangement equating or exceeding the predetermined threshold.

6. The downhole packer apparatus of claim 1, wherein the bypass arrangements are circumferentially distributed in the apparatus.

7. The downhole packer apparatus of claim 1, wherein the bypass arrangements are configured for sequential operation.

8. The downhole packer apparatus of claim 7, wherein a first of the bypass arrangements is configured for fluid communication with a first end of the apparatus to initiate sequential operation of the bypass arrangements in response to receiving fluid from the first end of the apparatus.

9. The downhole packer apparatus according to claim 1, wherein each bypass arrangement is a forward bypass arrangement which is configured to control fluid flow between the respective plurality of annulus portions in a first direction, and wherein the apparatus further comprises a reverse bypass arrangement operatively associated with each of the sealing elements, wherein each reverse bypass arrangement is configured to control fluid flow between the respective plurality of annulus portions in a second direction opposite the first direction.

10. The downhole packer apparatus of claim 9, wherein the reverse bypass arrangements are configured for sequential operation in a sequence of operation opposite to a sequence of operation of the forward bypass arrangements.

11. The downhole packer apparatus of claim 9, wherein a first of the reverse bypass arrangements is configured for fluid communication with a second end of the apparatus to initiate a sequential operation of the reverse bypass arrangements in response to receiving fluid from the second end of the apparatus.

12. A method of establishing a seal in an annulus between a downhole apparatus and a wall of a bore or bore-lining tubing, wherein the downhole apparatus comprises:

a body;

a plurality of sealing elements configured for mounting on the body, each sealing element configured to engage the wall of the bore or bore-lining tubing so as to divide the annulus into a plurality of annulus portions;

a bypass arrangement operatively associated with each of the sealing elements, each bypass arrangement having a fluid communication arrangement for communicating fluid between the respective plurality of annulus portions, and a valve arrangement configured to control fluid flow between the respective plurality of annulus portions via the fluid communication arrangement; and a valve sleeve associated with each annulus portion, wherein each fluid communication arrangement comprises;

a sealed space between the valve sleeve associated with a first annulus portion of the respective plurality of annulus portions, and the body; and a conduit extending through the body and configured to communicate fluid between the sealed space and the second annulus portion of the respective plurality of annulus portions;

and wherein the method comprises:

reconfiguring the valve arrangement of the downhole apparatus from a first configuration in which fluid communication between the respective plurality of annulus portions of the downhole apparatus is prevented and a second configuration in which fluid communication between the respective plurality of annulus portions of the downhole apparatus is permitted, in response to a predetermined threshold pressure differential across the valve arrangement.

13. The method of claim 12, wherein the bypass arrangements are forward bypass arrangements, and the method comprises controlling fluid flow between the respective plurality of annulus portions in a first direction.

14. The method of claim 13, wherein the apparatus further comprises a reverse bypass arrangement operatively associated with each of the sealing elements, and the method further comprises controlling fluid flow between the respective plurality of annulus portions in a second direction opposite the first direction.

* * * * *